US006957703B2

(12) United States Patent
Trott et al.

(10) Patent No.: US 6,957,703 B2
(45) Date of Patent: Oct. 25, 2005

(54) CLOSURE MECHANISM WITH INTEGRATED ACTUATOR FOR SUBSURFACE VALVES

(75) Inventors: Douglas Trott, Coweta, OK (US); Brian Shaw, Broken Arrow, OK (US); David McMahon, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 80 days.

(21) Appl. No.: 10/300,046

(22) Filed: Nov. 19, 2002

(65) Prior Publication Data

US 2003/0121665 A1 Jul. 3, 2003

Related U.S. Application Data

(60) Provisional application No. 60/334,321, filed on Nov. 30, 2001.

(51) Int. Cl.[7] ..... E21B 34/10

(52) U.S. Cl. ..... 166/332.8; 166/321; 251/336

(58) Field of Search ..... 166/332.8, 321, 166/325, 316; 137/515, 515.5, 527, 535, 536, 527.4, 515.7; 251/298, 337, 336

(56) References Cited

U.S. PATENT DOCUMENTS

| | | | | |
|---|---|---|---|---|
| 2,780,290 A | | 2/1957 | Natho | |
| 2,798,561 A | | 7/1957 | True | |
| 3,482,603 A | * | 12/1969 | Outcalt | 137/515.5 |
| 3,817,278 A | | 6/1974 | Elliott | |
| 3,830,306 A | | 8/1974 | Brown | |
| 3,958,633 A | | 5/1976 | Britch et al. | |
| 3,980,135 A | | 9/1976 | Garrett | |
| 4,019,532 A | | 4/1977 | Schittek | |
| 4,168,772 A | | 9/1979 | Eberle | |
| 4,407,325 A | | 10/1983 | Chernik | |
| 4,422,618 A | | 12/1983 | Lawson | |
| 4,503,913 A | | 3/1985 | Carmody | |
| 4,531,587 A | | 7/1985 | Fineberg | |
| 4,585,026 A | * | 4/1986 | Norton | 137/512.1 |
| 4,669,500 A | | 6/1987 | Strelow | |
| 4,782,895 A | | 11/1988 | Jacob et al. | |
| 5,137,090 A | | 8/1992 | Hare et al. | |
| 5,145,005 A | | 9/1992 | Dollison | |
| 5,156,374 A | | 10/1992 | Fort et al. | |
| 5,159,981 A | * | 11/1992 | Le | 166/325 |
| 5,201,371 A | | 4/1993 | Allen | |
| 5,310,005 A | | 5/1994 | Dollison | |
| 5,411,056 A | | 5/1995 | Solaroli | |
| 5,564,502 A | * | 10/1996 | Crow et al. | 166/386 |
| 5,794,655 A | | 8/1998 | Funderburk et al. | |
| 6,003,605 A | | 12/1999 | Dickson et al. | |
| 6,199,381 B1 | | 3/2001 | Unger et al. | |
| 6,227,299 B1 | * | 5/2001 | Dennistoun | 166/332.8 |
| 6,253,843 B1 | | 7/2001 | Rawson et al. | |
| 6,269,874 B1 | | 8/2001 | Rawson et al. | |
| 6,328,062 B1 | | 12/2001 | Williams et al. | |
| 2003/0178199 A1 | * | 9/2003 | Deaton | 166/332.8 |

FOREIGN PATENT DOCUMENTS

| | | |
|---|---|---|
| GB | 1308954 | 3/1973 |
| GB | 1563487 | 3/1980 |
| GB | 2198170 | 6/1988 |
| GB | 2236549 | 4/1991 |
| WO | WO 86/05853 | 10/1986 |

* cited by examiner

*Primary Examiner*—David Bagnell
*Assistant Examiner*—Daniel P Stephenson
(74) *Attorney, Agent, or Firm*—Steve Rosenblatt

(57) ABSTRACT

A subsurface safety valve has a closure sleeve or rod mounted below the closure mechanism. Control signal pushes the sleeve up (uphole) or down (downhole), whichever is applicable, which causes the closure element to rotate (or slide, or otherwise translate) to its open position. A loss of control signal allows the closure spring to push the sleeve or rod downhole (or uphole, whichever is appropriate). This movement causes the closure element to be driven to its closed position against the seat.

24 Claims, 2 Drawing Sheets

CLOSURE MECHANISM WITH INTEGRATED ACTUATOR FOR SUBSURFACE VALVES

PRIORITY INFORMATION

This application claims the benefit of U.S. Provisional Application No. 60/334,321 filed on Nov. 30, 2001.

FIELD OF THE INVENTION

The field of this invention is surface controlled subsurface safety valves and more particularly actuating mechanisms for the closure element.

BACKGROUND OF THE INVENTION

Traditionally, sub-surface safety valves (SSSV) have had a flat or curved closure element known as a flapper, or a ball-shaped closure element, which rotates approximately 90 degrees, from opened to closed positions, under the bias of a closure spring generally mounted to the hinge holding the closure element to the valve body. The closure spring acts on the closure element after a flow tube or other actuating element is retracted. The flow tube and actuator mechanism are typically mounted above the closure element and inside the seat against which the closure element contacts for closure. The flow tube and actuator are biased in the uphole (closed) direction by a separate spring, commonly known as the power spring, and are driven down against the spring bias and into the closure element by pressure (or other appropriate signal) delivered through a control line extending to the SSSV from the surface. As long as control line pressure (or other appropriate signal) is applied to the actuator the power spring bias on the flow tube is overcome and the flow tube stays in a down (open) position. In the down position of the flow tube, the closure element is rotated against the bias of the closure spring, and away from contact with the mating seat. The closure element winds up behind or adjacent to the flow tube when the SSSV is open. If control line pressure (or signal) is lost, the power spring bias on the flow tube pushes it and the actuator mechanism uphole. This movement, in turn, allows the closure spring, acting on the closure element, to rotate the closure element on its hinge in an uphole direction until it makes contact with the mating seat.

Traditionally, the flow tube and the actuator mechanism have always been above the closure element. This required the bias (power) spring on the flow tube to support the weight and overcome friction of the flow tube as well as to bias it uphole to allow the closure element to shut. Since the flapper had to rotate 90 degrees in the uphole direction to close the SSSV, a hinge closure spring was always necessary to create that motion to overcome the weight of the flapper and apply a contact force to it to hold it against its mating seat. As a result of this configuration, the overall length of SSSVs was longer than it needed to be. In low pressure applications, there was concern about the ability of the closure spring on the flapper to apply a sufficient closing force against the mating seat to keep the SSSV closed. This concern also arose when there was sand, paraffin, asphaltine or other friction increasing compounds in the well fluids, creating doubt as to the available closure force on the flow tube from its power spring. If the flow tube gets stuck, the SSSV cannot close.

The present invention presents a unique design where the actuator mechanism is below the flapper. The power spring acts on a sleeve or rod operably connected to the flapper on an opposed side of the pivot mounting. The spring pushes the sleeve or rod downhole to rotate the flapper closed, upon loss of control line signal. The details and other features of the invention will become more readily apparent from a detailed review of the description of the preferred embodiment, which appears below.

SUMMARY OF THE INVENTION

A subsurface safety valve has a closure sleeve or rod mounted below the closure mechanism. Control signal pushes the sleeve up (uphole) or down (downhole), whichever is applicable, which causes the closure element to rotate (or slide, or otherwise translate) to its open position. A loss of control signal allows the closure spring to push the sleeve or rod downhole (or uphole, whichever is appropriate). This movement causes the closure element to be driven to its closed position against the seat.

DETAILED DESCRIPTION OF THE PREFERRED EMBODIMENT

Figure 1:
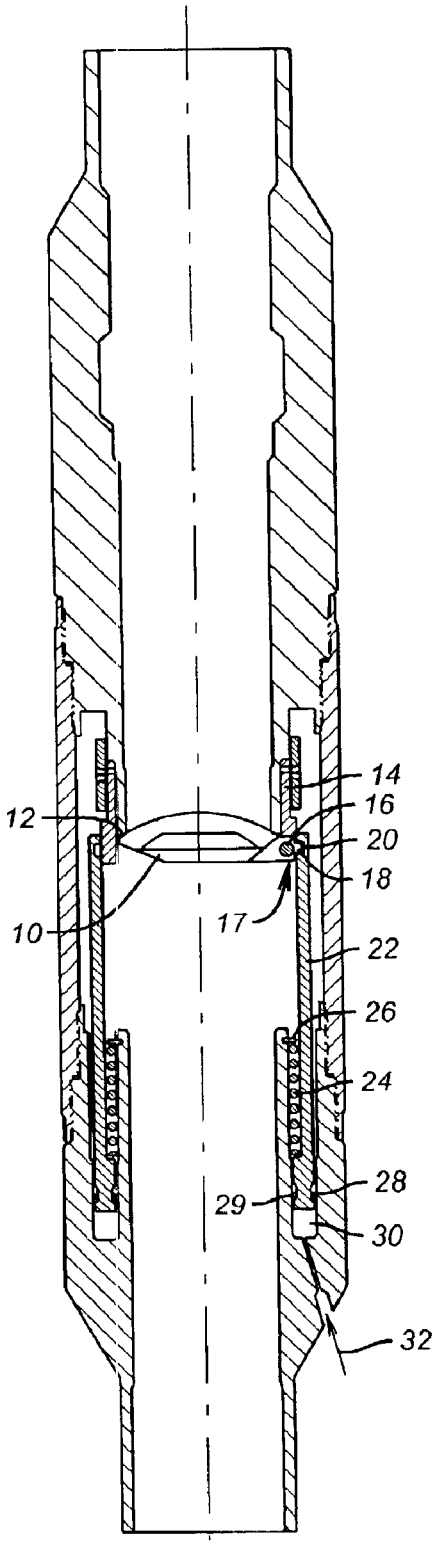
FIG. 1 is a sectional elevation view of the safety valve of the present invention in the closed position using an annular sleeve to actuate the flapper

Referring to FIG. 1, the flapper 10 is shown in the closed position against a seat 12 located in body 14 of the SSV. The flapper 10 is connected to body 14 at pin 16 and hinge 17. Extending away from the sealing portion of the flapper 10 in contact with the seat 12 is an arm 18. Arm 18 extends into a groove 20 in annular piston 22. Spring 24 acting against stop 26 biases annular piston 22 downwardly. Seals 28 and 29 define a variable volume annular cavity 30. Arrow 32 shows schematically how the control line communicates hydraulic pressure (signal) from the well surface to overcome the downward bias of spring 24. Those skilled in the art will appreciate that the signal can be surface or downhole generated and can take various forms. The control system can involve electro-hydraulic (U.S. Pat. No. 6,269,874), electromechanical (U.S. Pat. No. 6,253,843), and photo-hydraulic techniques. When enough pressure is applied or some other signal is transmitted such as electromechanical, acoustic, or electromagnetic, for example, the annular piston moves up and rotates arm 18 about pin 16 to rotate the flapper 10 away from seat 12. If pressure or other signal is removed or lost in the control line represented by arrow 32 or due to leakage of seal 28 or for other reasons, the spring 24 will push the annular piston downhole. Groove 20 will rotate arm 18 clockwise to forcibly bring the flapper 10 into contact with the seat 12.

Figure 3:
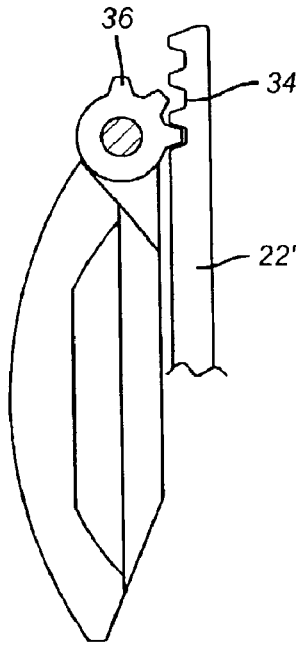
FIG. 3 is a section view of a rack and pinion assembly for operating the flapper

The arm 18 extending into the groove 20 can be replaced with a rack and pinion design, as shown in FIG. 3. Annular piston 22' has teeth 34 which extend into contact with pinion 36. Pinion 36 is attached or made integral with the flapper 10. In each instance movement of the annular piston 22 or 22' in opposed directions results in a desired 90 degree rotational movement of the flapper 10. The torsion spring for flapper closure in prior designs has been eliminated. In this design there is only one spring 24. Due to the orientation of the annular piston 22 below the flapper 10, the weight of the annular piston 22 adds to the closure force of spring 24 on flapper 10. Additionally using arm 18 extending into groove 20 or the rack and pinion connection shown in FIG. 3, the stroke length of the annular piston 22 is significantly reduced as compared to prior designs having a flow tube and actuator above the flapper. In the prior designs, the stroke length had to be longer to get the flow tube down far enough so that the entire flapper would be disposed behind it. For a similar size SSV the overall length of the present design could be significantly shorter since the stroke length has been reduced from several inches for a traditional flow tube to less than an inch for the versions of the present invention shown in FIGS. 1 and 3.

Figure 2:
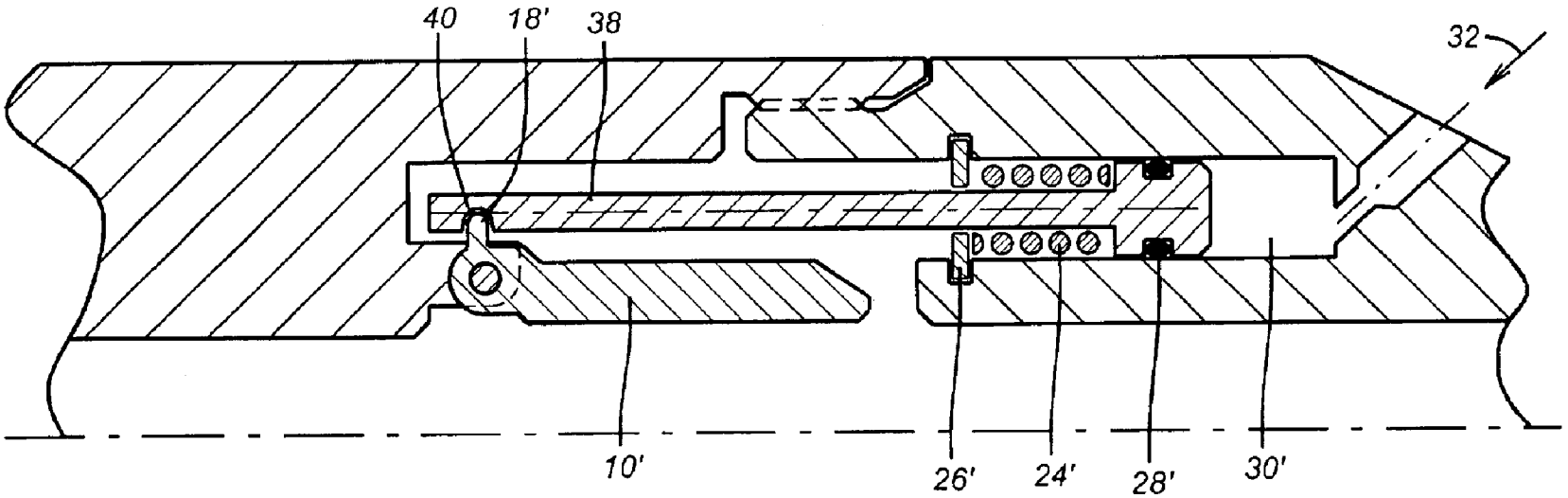
FIG. 2 is an alternative to FIG. 1 using a rod piston to actuate the flapper.

FIG. 2 is a schematic illustration showing the use of a rod piston 38 instead of the annular piston 22 shown in FIG. 1. The part positions and operation are otherwise the same as described for the FIG. 1 embodiment. The rod piston 38 can have a slot 40 into which arm 18' is engaged for forced movement of the flapper 10' in opposed directions. A rack and pinion design, as described above, can also be employed.

Those skilled in the art will appreciate that the present invention allows SSVs to be made shorter and more economically. Fewer moving parts also imply increased reliability. The torsion spring, the flow tube, and the components linking the piston to the flow tube are eliminated. A single spring forcibly moves the flapper and the piston to the closed position. The closure spring 24 does not have to support the weight of the piston 22 or 38 when moving the flapper 10 to its closed position. Control line pressure or other signal moves the piston 22 or 38, either of which is linked directly to the flapper for application of a moment to rotate it to the open position. Those skilled in the art will appreciate that a variety of connections can be used between a piston mounted below the flapper and the flapper, as being contemplated by the invention. While direct contact, such as arm 32 extending into groove 20 is preferred, indirect contact is also envisioned. For example, an arrangement of components can be envisioned such that the piston is urged in the opposite direction as that described above. In this case, indirect contact between the arm (or sleeve) and the closure element may be appropriate.

Figure 4:
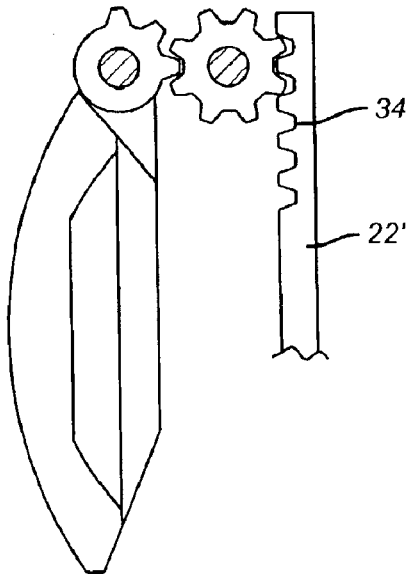
FIG. 4 is an alternative to FIG. 1 illustrating an actuator which moves in the opposite direction as that of FIG. 1, yet accomplishes the same task—moving the closure element to the closed position.

Those skilled in the art will appreciate that the closure element can be a flapper, a ball, a sliding gate or any other device that effects closure. Reference to one type of closure element is intended to encompass any of the known alternative designs. The actuator can be linked to the closure member directly such as when the rack and pinion mechanism illustrated in FIG. 3 is employed. The actuator can be linked to the closure member indirectly such as when the actuator is configured to move uphole to close the closure element, as shown in FIG. 4. The disclosed embodiments allow the safety valve to be shorter in overall length and have fewer moving parts than prior designs, thus offering greater reliability. Another advantage is that a single biasing source, such as a closure spring operates both the actuator and the closure element.

The full extent of the invention is delineated in the claims below.

We claim:

1. A downhole safety valve for a tubular string operated by at least one control line extending independently of the tubular string to the safety valve, comprising:

a housing having uphole and downhole ends and a bore extending therethrough and a connection for a control line;

a closure element mounted to said housing in said bore;

an actuator in fluid communication with said connection for a control line to move said closure element to an open position in response to pressure changes from the control line, said connection mounted substantially between said closure element and said downhole end of said housing; and the weight of said actuator provides at least part of the force to urge said closure element to said closed position.

2. The safety valve of claim 1, wherein:

said actuator forcibly pivots said closure element selectively in opposed directions.

3. The safety valve of claim 1, wherein:

said actuator is connected directly to said closure element.

4. The safety valve of claim 3, wherein:

said closure element comprises a binge extending beyond a mounting pin supported by said housing;

said actuator is connected to said extending hinge portion beyond said mounting pin.

5. The safety valve of claim 4, wherein:

said connection between said actuator and said hinge portion is accomplished by meshing gears.

6. The safety valve of claim 4, wherein:

said connection between said actuator and said hinge portion is accomplished by a projection on one engaging a depression in the other.

7. The safety valve of claim 4, wherein:

said actuator comprises a rod piston mounted in said housing.

8. The safety valve of claim 4, wherein:

said closure element pivots between an open and a closed position; and said actuator is biased to urge said closure element toward said closed position.

9. The safety valve of claim 8, wherein:

said actuator defines a variable volume cavity in said body, said cavity having an inlet on the housing to facilitate movement of said actuator against said bias.

10. The safety valve of claim 9, wherein:

said actuator forcibly pivots said closure element selectively in opposed directions.

11. The safety valve of claim 10, wherein:

the weight of said actuator provides at least part of the force to urge said closure element to said closed position.

12. The safety valve of claim 11, wherein:

said connection between said actuator and said hinge portion is accomplished by meshing gears.

13. The safety valve of claim 12, wherein:

said actuator comprises a rod piston mounted in said housing.

14. The safety valve of claim 11, wherein:

said connection between said actuator and said hinge portion is accomplished by a projection on one engaging a depression in the other.

15. The safety valve of claim 14, wherein:

said actuator comprises a rod piston mounted in said housing.

16. The safety valve of claim 1, wherein:

said actuator moves toward said downhole end to move said closure element to a closed position.

17.The safety valve of claim 1, wherein:

said closure element comprises one of a flapper, a ball and a sliding gate.

18. The safety valve of claim 1, wherein:

said actuator and said closure element are urged toward said closed position by a single biasing element.

19. A downhole safety valve for a tubular string, comprising:

a housing having uphole and downhole ends and a bore extending therethrough;

a closure element mounted to said housing in said bore; and an actuator responsive to input from outside the tubular string to move said closure element to an open position, said actuator mounted substantially between said closure element and said downhole end of said housing;

said actuator is connected directly to said closure element;

said closure element comprises a hinge extending beyond a mounting pin supported by said housing;

said actuator is connected to said extending hinge portion beyond said mounting pin.

20. A downhole safety valve for a tubular string operated by at least one control line extending independently of the tubular string to the safety valve comprising:

a housing having uphole and downhole ends and a bore extending therethrough and a connection for a control line;

a closure element mounted to said housing in said bore; and an actuator in fluid communication with said connection for a control line to move said closure element to an open position in response to pressure changes from the control line, said actuator mounted substantially between said closure element and said downhole end of said housing; the weight of said actuator provides at least part of the force to urge said closure element to said closed position;

said actuator is connected directly to said closure element;

said closure element comprises a hinge extending beyond a mounting pin supported by said housing;

said actuator is connected to said extending hinge portion beyond said mounting pin;

said closure element pivots between an open and a closed position; and said actuator is biased to urge said closure element toward said closed position;

said actuator defines a variable volume cavity in said body, said cavity having an inlet on the housing to facilitate movement of said actuator against said bias;

said inlet is located between said closure element and said downhole end of said housing.

21. A downhole safety valve for a tubular string operated by at least one control line extending independently of the tubular string to the safety valve, comprising:

a housing having uphole and downhole ends and a bore extending therethrough and a connection for a control line;

a closure element mounted to said housing in said bore; and an actuator in fluid communication with said connection for a control line to move said closure element to an open position in response to pressure changes from the control line, said actuator mounted substantially between said closure element and said downhole end of said housing;

the weight of said actuator provides at least part of the force to urge said closure element to said closed position;

said actuator is connected directly to said closure element; said closure element comprises a hinge extending beyond a mounting pin supported by said housing;

said actuator is connected to said extending hinge Portion beyond said mounting pin;

said closure element pivots between an open and a closed position; and said actuator is biased to urge said closure element toward said closed position;

said actuator defines a variable volume cavity in said body, said cavity having an inlet on the housing to facilitate movement of said actuator against said bias;

said actuator forcibly pivots said closure element selectively in opposed directions;

the weight of said actuator provides at least part of the force to urge said closure element to said closed position;

said connection between said actuator and said hinge portion is accomplished by meshing gears;

said actuator comprises an annular piston mounted in said housing.

22. A downhole safety valve for a tubular string operated by at least one control line extending independently of the tubular string to the safety valve, comprising:

a housing having uphole and downhole ends and a bore extending therethrough and a connection for a control line;

a closure element mounted to said housing in said bore; and an actuator in fluid communication with said connection for a control line to move said closure element to an open position in response to pressure changes from the control line, said actuator mounted substantially between said closure element and said downhole end of said housing;

the weight of said actuator provides at least part of the force to urge said closure element to said closed position;

said actuator is connected directly to said closure element;

said closure element comprises a hinge extending beyond a mounting pin supported by said housing;

said actuator is connected to said extending hinge portion beyond said mounting pin;

said closure element pivots between an open and a closed position; and said actuator is biased to urge said closure element toward said closed position;

said actuator defines a variable volume cavity in said body, said cavity having an inlet on the housing to facilitate movement of said actuator against said bias;

said actuator forcibly pivots said closure element selectively in opposed directions;

the weight of said actuator provides at least part of the force to urge said closure element to said closed position;

said connection between said actuator and said hinge portion is accomplished by a projection on one engaging a depression in the other;

said actuator comprises an annular piston mounted in said housing.

23. A downhole safety valve, comprising:

a housing having uphole and downhole ends;

a closure element mounted to said housing; and an actuator to move said closure element, said actuator mounted substantially between said closure element and said downhole end of said housing;

said actuator is connected indirectly to said closure element.

24. The safety valve of claim 23, wherein:

said actuator moves toward said uphole end to move said closure element to a closed position.

* * * * *